US009657374B2

(12) United States Patent
Miyata et al.

(10) Patent No.: US 9,657,374 B2
(45) Date of Patent: May 23, 2017

(54) FREE-MACHINING ALUMINUM ALLOY EXTRUDED MATERIAL WITH REDUCED SURFACE ROUGHNESS AND EXCELLENT PRODUCTIVITY

(71) Applicant: Kobe Steel, Ltd., Kobe-shi (JP)

(72) Inventors: Yukimasa Miyata, Shimonoseki (JP); Shinji Yoshihara, Shimonoseki (JP); Takahiro Shikama, Shimonoseki (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/915,006

(22) PCT Filed: Aug. 28, 2014

(86) PCT No.: PCT/JP2014/072592

§ 371 (c)(1),
(2) Date: Feb. 26, 2016

(87) PCT Pub. No.: WO2015/030121

PCT Pub. Date: Mar. 5, 2015

(65) Prior Publication Data

US 2016/0208368 A1 Jul. 21, 2016

(30) Foreign Application Priority Data

Aug. 29, 2013 (JP) ..... 2013-177572
Jul. 31, 2014 (JP) ..... 2014-156634

(51) Int. Cl.
*C22F 1/043* (2006.01)
*C22C 21/02* (2006.01)
(Continued)

(52) U.S. Cl.
CPC ..... *C22C 21/02* (2013.01); *B21C 23/002* (2013.01); *B21C 29/003* (2013.01); *C22F 1/043* (2013.01)

(58) Field of Classification Search
CPC ..... C22F 1/043; C22C 21/02; C22C 21/04
See application file for complete search history.

(56) References Cited

U.S. PATENT DOCUMENTS 6,059,902 A 5/2000 Yoshihara et al.
2004/0223869 A1* 11/2004 Takase ..... C22C 21/02 420/534

(Continued)

FOREIGN PATENT DOCUMENTS

CN 101545063 9/2009
JP 6-145919 A 5/1994

(Continued)

OTHER PUBLICATIONS

International Search Report issued Nov. 11, 2014, in PCT/JP2014/072592 filed Aug. 28, 2014.

(Continued)

*Primary Examiner* — Roy King
*Assistant Examiner* — Janelle Morillo
(74) *Attorney, Agent, or Firm* — Oblon, McClelland, Maier & Neustadt, L.L.P.

(57) ABSTRACT

To obtain an Al—Mg—Si based aluminum alloy extruded material with a smooth surface and no burning without inhibiting the productivity. An aluminum alloy billet includes: Si: 2.0 to 6.0% by mass; Mg: 0.3 to 1.2% by mass; and Ti: 0.01 to 0.2% by mass, a Fe content being restricted to 0.2% or less by mass, with the balance being Al and inevitable impurities. The aluminum alloy billet is subjected to a homogenization treatment by keeping at 500 to 550° C. for 4 to 15 hours. The billet is forcibly cooled to 250° C. or lower at an average cooling rate of 50° C./hr or higher. Then, the billet is subjected to hot-extruding at an extrusion rate of 3 to 10 m/min by being heating at 450 to 500° C. The extruded material is forcibly cooled at an average cooling rate of 50° C./sec or higher and then subjected to an aging (Continued)

treatment. The extruded material can be manufactured that has its surface having a ten-point average roughness Rz of 80 μm or less.

13 Claims, 4 Drawing Sheets

(51) Int. Cl.
*B21C 29/00* (2006.01)
*B21C 23/00* (2006.01)

(56) References Cited

U.S. PATENT DOCUMENTS

| | | | | |
|---|---|---|---|---|
| 2005/0109429 | A1 | 5/2005 | Okamoto et al. | |
| 2009/0242087 | A1 | 10/2009 | Morita et al. | |
| 2009/0301611 | A1* | 12/2009 | Parson | C22C 21/00 148/439 |
| 2011/0247736 | A1 | 10/2011 | Morita et al. | |

FOREIGN PATENT DOCUMENTS

| | | | |
|---|---|---|---|
| JP | 9-249931 | A | 9/1997 |
| JP | 10-8175 | A | 1/1998 |
| JP | 2002-47525 | A | 2/2002 |
| JP | 2003-147468 | A | 5/2003 |

OTHER PUBLICATIONS

"Aluminum no Soshiki to Seishitsu", Edited by 40 Shunen Kinen Jigyo Jikko linkai Kinen Shuppan Bukai, (Nov. 30, 1991), pp. 287-289, with English Translation, 14 pages.

International Preliminary Report on Patentability and Written Opinion of the International Searching Authority issued Mar. 10, 2016 in PCT/JP2014/072592 (with English language translation).

Chinese Office Action issued Oct. 9, 2016 Oct. 9, 2016 in connection with corresponding Chinese Patent Application No. 201480046489.4, filed Dec. 26, 2014.

US Office Action issued Jan. 25, 2017 in connection with corresponding U.S. Appl. No. 15/222,608, filed Jul. 28, 2016.

* cited by examiner

Fig. 2A Billet after homogenization treatment

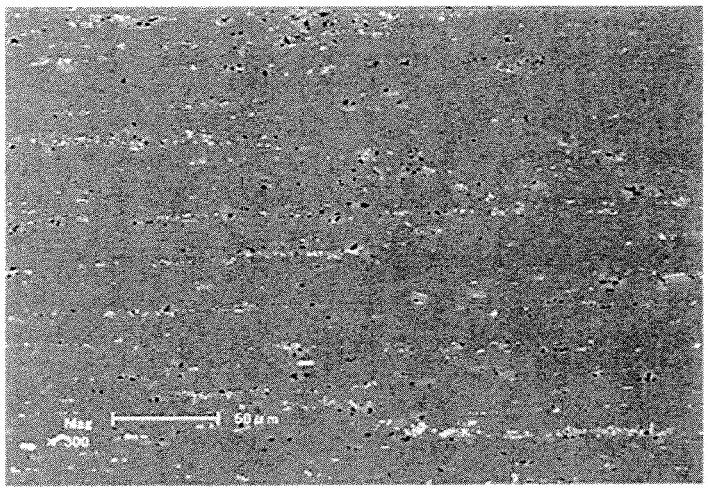
Fig. 2B Extruded material
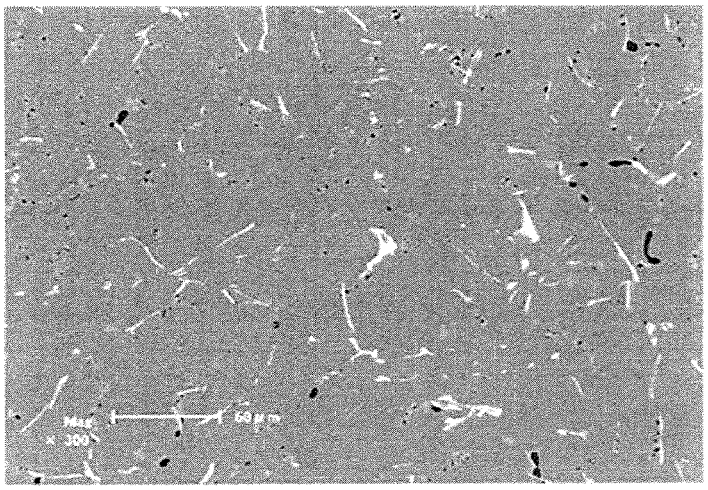
Fig. 3A Billet after homogenization treatment

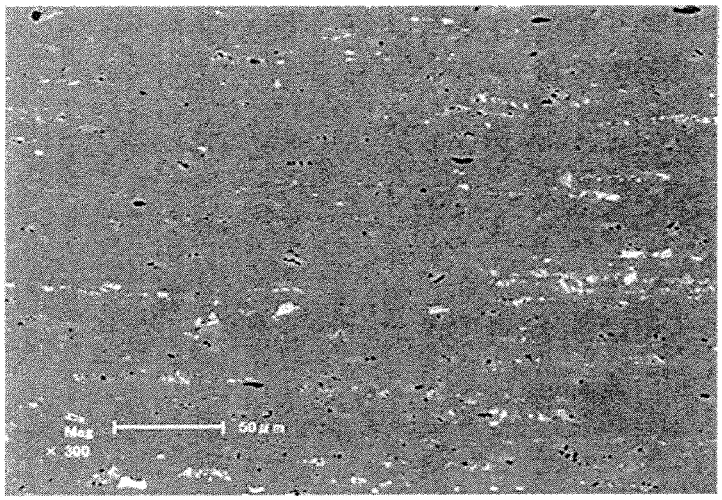
Fig. 3B Extruded material
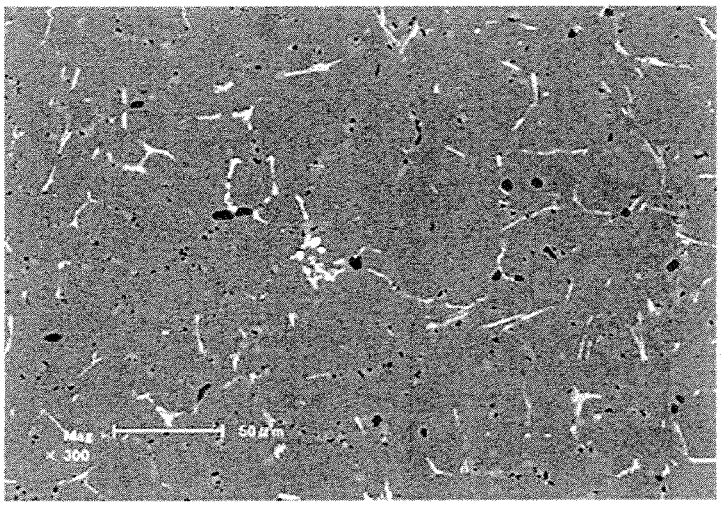
Fig. 4A Billet after homogenization treatment

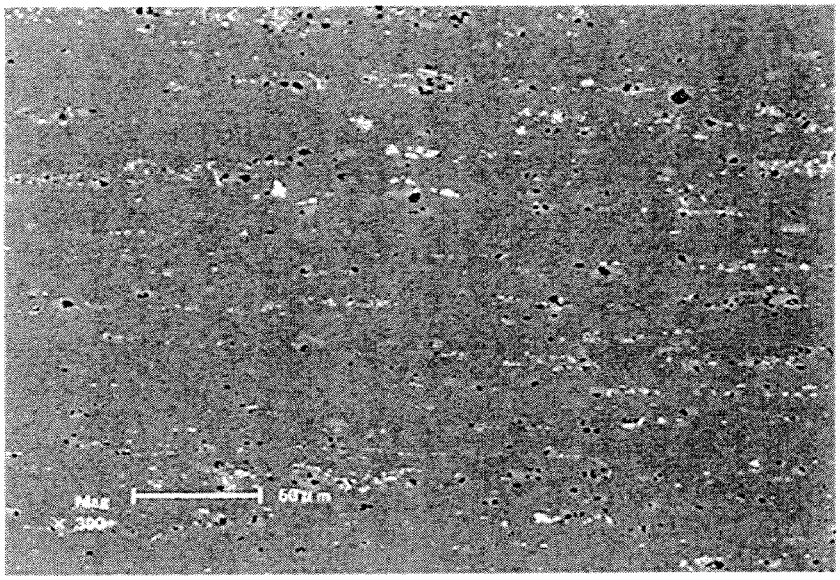
Fig. 4B Extruded material

FREE-MACHINING ALUMINUM ALLOY EXTRUDED MATERIAL WITH REDUCED SURFACE ROUGHNESS AND EXCELLENT PRODUCTIVITY

TECHNICAL FIELD

The present invention relates to an Al—Mg—Si based aluminum alloy extruded material that is suitable for use in mechanical parts and the like, requiring many machining processes during manufacturing procedures and that has high strength and excellent machinability, and also to a manufacturing method thereof.

BACKGROUND ART

Patent Documents 1 to 4 disclose the Al—Mg—Si based aluminum alloy extruded materials for machining. To improve the machinability in these aluminum alloy extruded materials for machining, 1.5% or more by mass of Si is added, and a large amount of Si crystallized grains (Si phase), which are second-phase hard particles, are distributed in a matrix.

PRIOR ART DOCUMENT

Patent Document

Patent Document 1: JP 9-249931 A
Patent Document 2: JP 10-8175 A
Patent Document 3: JP 2002-47525 A
Patent Document 4: JP 2003-147468 A

DISCLOSURE OF THE INVENTION

Problems to be Solved by the Invention

The Al—Mg—Si based aluminum alloy for machining crystallizes into Si and $Mg_2Si$ during the solidification process, and also crystallizes into a needle-like β-AlFeSi-based compound (β-AlFeSi phase) made of Fe as inevitable impurities, and Al and Si. FIG. 1 shows a micrograph of a billet before a homogenization treatment. Strip-shaped Si phases (in gray) are connected in a net shape, in which $Mg_2Si$ phases (in black) are distributed as dots, while needle-like β-AlFeSi phases (in white) are formed along the Si phases. Extruding the Al—Mg—Si based aluminum alloy billet poses a problem in which burning (pickup) might occur in extruded materials, degrading the smoothness of the surface of the extruded material.

The occurrence of burning in the Al—Mg—Si based aluminum alloy extruded material is based on the following reasons. The strip-shaped Si phases existing in the billet before extruding cause a eutectic reaction with an Al phase and a $Mg_2Si$ phase due to the deformation of material by extruding and the heat generation during the process resulting from the friction between the material and a die-bearing portion, thereby causing local melting. A shearing force upon the extruded material when it passes through the die-bearing portion makes the material of the surface of the extruded material (cells surrounded by the Si phases) fall off starting at the melting point, causing burning of the extruded material.

Further, the needle-like β-AlFeSi phases existing in the billet before extruding cause a eutectic reaction with a $Mg_2Si$ phase due to heat generation during the extrusion process, causing local melting. If local melting continuously occurs to couple melted parts, the material on the surface of the extruded material will fall off due to the shearing force that the extruded material receives when passing through the die-bearing portion, causing burning of the extruded material.

Although the inner peripheral surface of the die is mirror-finished, the occurrence of burning might coarsen the surface of the extruded material, losing the smoothness thereof.

The burning generated by the eutectic reaction in the Si, Al, and $Mg_2Si$ phases can be reduced by applying the homogenization treatment to the billet before extruding, at a temperature of 500 to 550° C. for four hours or more, and separating (spheroidizing) the Si phase crystallized in the strip shape.

On the other hand, the burning generated by the peritectic reaction between the β-AlFeSi and $Mg_2Si$ phases can be reduced by conducting homogenization treatment at a temperature of 500° C. or higher for a long time (approximately 50 hours when Si and Fe contents are large), thereby converting the β-AlFeSi phase into α phase (spherodizing), or by decreasing the extrusion rate to reduce the amount of heat generated during processing. However, the long-term homogenization treatment inhibits productivity and is disadvantageous in terms of cost. Further, the reduction in the extrusion rate also inhibits productivity.

The present invention has been made in view of the foregoing problems associated with manufacturing of an Al—Mg—Si based aluminum alloy extruded material for machining, and it is an object of the present invention to obtain an Al—Mg—Si based aluminum alloy extruded material with a smooth surface and no burning without requiring the long-term homogenization treatment and the reduction in extrusion rate.

Means for Solving the Problems

An Al—Mg—Si based aluminum alloy extruded material according to the present invention includes: Si: 2.0 to 6.0% by mass; Mg: 0.3 to 1.2% by mass; and Ti: 0.01 to 0.2% by mass, a Fe content being restricted to 0.2% or less by mass, with the balance being Al and inevitable impurities, wherein the number of AlFeSi particles having a diameter of 5 μm or more is 20 or less per 50 μm square area of the extruded material, and the number of $Mg_2Si$ particles having a diameter of 2 μm or more is 20 or less per 50 μm square area of the extruded material, and wherein a ten-point average roughness Rz of a surface of the extruded material is 80 μm or less. The aluminum alloy extruded material can further contain one or more kinds of: Mn: 0.1 to 1.0% by mass; and Cu: 0.1 to 0.4% by mass, as needed. The aluminum alloy extruded material can further contain one or more kinds of: Cr: 0.03 to 0.1% by mass; and Zr: 0.03 to 0.1% by mass, as needed.

A method for manufacturing an Al—Mg—Si based aluminum alloy extruded material according to the present invention includes the steps of: applying a homogenization treatment to an aluminum alloy billet having the above-mentioned composition by keeping at 500 to 550° C. for 4 to 15 hours; forcibly cooling the billet to 250° C. or lower at an average cooling rate of 50° C./hr or higher; hot-extruding the billet at an extrusion rate of 3 to 10 m/min by heating at 450 to 500° C.; forcibly cooling the extruded material at an average cooling rate of 50° C./sec or higher; and applying an aging treatment to the extruded material. By this manufacturing method, the above-mentioned Al—Mg—Si based aluminum alloy extruded material according to the present invention can be obtained.

Effects of the Invention

Accordingly, the present invention can obtain the Al—Si—Mg based aluminum alloy extruded material with excellent machinability and a smooth surface having a ten-point average roughness Rz of 80 μm or less, while reducing burning without being accompanied by the long-term homogenization treatment as well as reduction in extrusion rate in the manufacture of the Al—Si—Mg based aluminum alloy extruded material having a relatively large Si content.

The Al—Si—Mg based aluminum alloy extruded material in the present invention has high strength, excellent machinability, and good appearance due to the smooth surface. Thus, the Al—Si—Mg based aluminum alloy extruded material enables reduction in amount of machining processing, and can, in some cases, have a part of its surface used as a surface of a product as it is (without machining).

BRIEF DESCRIPTION OF THE DRAWINGS

FIG. 2A shows a scanning electron micrograph of a billet in Example No. 1 after the homogenization treatment.

FIG. 2B shows a scanning electron micrograph of an extruded material obtained from the billet in Example No. 1.

FIG. 3A shows a scanning electron micrograph of a billet in Example No. 12 after the homogenization treatment.

FIG. 3B shows a scanning electron micrograph of an extruded material obtained from the billet in Example No. 12.

FIG. 4A shows a scanning electron micrograph of a billet in Example No. 13 after the homogenization treatment.

FIG. 4B shows a scanning electron micrograph of an extruded material obtained from the billet in Example No. 13.

BEST MODE FOR CARRYING OUT THE INVENTION

Figure 1:
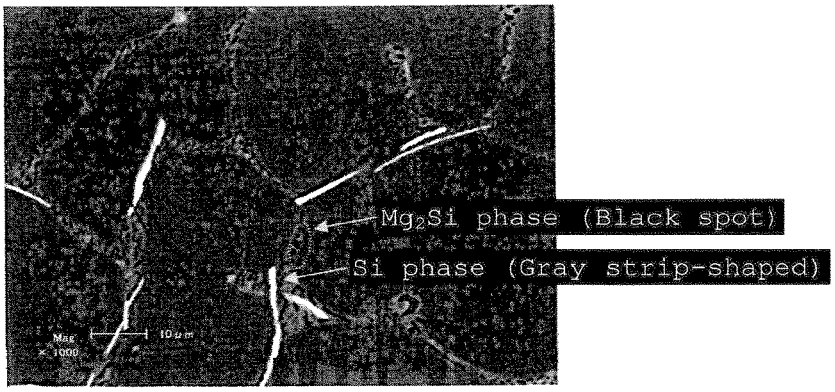
FIG. 1 shows a scanning electron micrograph of a billet before a homogenization treatment.
Figure 1:
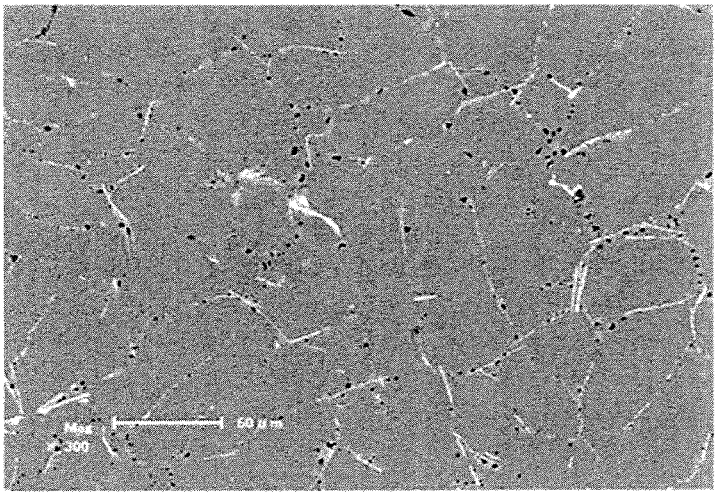

An Al—Si—Mg based aluminum alloy extruded material and a manufacturing method therefor according to the present invention will be described in more detail below.

(Aluminum Alloy Composition)

An aluminum alloy in the present invention includes: Si: 2.0 to 6.0% by mass; Mg: 0.3 to 1.2% by mass; and Ti: 0.01 to 0.2% by mass, with the balance being Al and inevitable impurities. The aluminum alloy further includes one or more kinds of: Mn: 0.1 to 1.0% by mass; and Cu: 0.1 to 0.4% by mass, as needed. Moreover, the aluminum alloy includes one or more kinds of: Cr: 0.03 to 0.1% by mass; and Zr: 0.03 to 0.1% by mass, as needed. Although the aluminum alloy compositions itself is well known, the present invention is characterized by that a Fe content in the inevitable impurities is restricted to 0.2% or less by mass. Each component of the aluminum alloy in the present invention will be described below.

Si: 2.0 to 6.0% by Mass

Silicon (Si) serves to form Si-based crystallized grains (Si phase) in aluminum, which are second-phase hard particles, and to improve the fragmentation of chips and the machinability. To this end, Si needs to be added in an amount of 2% or more by mass that exceeds the amount of solid solution of Si into aluminum. On the other hand, the addition of more than 6% by mass of Si might form coarsened Si phases, whereby the eutectic reaction among the Si phase, the Al phase, and $Mg_2Si$ phase occur to lower the melting start point. To prevent the occurrence of local melting and burning together with a decrease in melting start point, it is necessary to suppress the amount of heat during an extrusion process. For this reason, the extrusion rate needs to be reduced. Therefore, the Si content is set at 2.0 to 6.0% by mass. The lower limit of Si content is preferably 3.5% by mass, while the upper limit of Si content is preferably 4.5% by mass.

Mg: 0.3 to 1.2% by Mass

Magnesium (Mg) precipitates fine particles of $Mg_2Si$ by the aging precipitation treatment, thereby improving the strength of the extruded material. Thus, Mg is desirably added in an amount of 0.3% or more by mass. On the other hand, $Mg_2Si$ is also formed as crystallized grains during solidification and might cause peritectic reaction with β-AlFeSi during the extrusion, which leads to local melting, causing burning of the extruded material. When the Mg content exceeds 1.2% by mass, the crystallized grains of $Mg_2Si$ are formed in a large amount, so that the burning of the extruded material tends to easily occur. Therefore, the Mg content is set at 0.3 to 1.2% by mass. The lower limit of Mg content is preferably 0.5% by mass, while the upper limit of Mg content is preferably 0.9% by mass.

Ti: 0.01 to 0.2% by Mass

Titanium (Ti) serves to refine a cast structure, thereby stabilizing the mechanical properties of the extruded material. To attain this effect, Ti is added. However, when the Ti content is less than 0.01% by mass, its effect cannot be obtained. On the other hand, even if the Ti content exceeds 0.2% by mass, the effect of refining cannot be further improved. Therefore, the Ti content is set at 0.01 to 0.2% by mass. The lower limit of Ti content is preferably 0.01% by mass, while the upper limit of Ti content is preferably 0.1% by mass.

Mn: 0.1 to 1.0% by Mass; and

Cu: 0.1 to 0.4% by Mass

Manganese (Mn) has an effect of improving the strength of extruded material by being precipitated as dispersion particles during the homogenization treatment to thereby refine crystal grains of the extruded material. For this reason, Mn is added as needed. When the Mn content is less than 0.1% by mass, the above-mentioned effect cannot be sufficiently exhibited. On the other hand, when the Mn content exceeds 1.0% by mass in adding Mn, the extrudability is degraded. Therefore, the Mn content is set at 0.1 to 1.0% by mass. The lower limit of Mn content is preferably 0.4% by mass, while the upper limit of Mn content is preferably 0.8% by mass.

Copper (Cu) is added as appropriate, instead of or together with Mn, to enhance the strength of the extruded material by being solid-soluted. When the Cu content is less than 0.1% by mass, the above-mentioned effect cannot be sufficiently exhibited. On the other hand, when the Cu content exceeds 0.4% by mass in adding Cu, the corrosion resistance and extrudability of the extruded material are degraded. Therefore, the Cu content is set at 0.1 to 0.4% by mass. The lower limit of Cu content is preferably 0.2% by mass, while the upper limit of Cu content is preferably 0.3% by mass.

Cr: 0.03 to 0.1% by Mass; and

Zr: 0.03 to 0.1% by Mass

Chrome (Cr) is added as appropriate to suppress recrystallization and refine crystal grains, thereby enhancing the strength of the extruded material. However, when the Cr content is less than 0.03% by mass, the above-mentioned effect cannot be sufficiently obtained. On the other hand, when the Cr content exceeds 0.1% by mass in adding Cr, burning tends to occur in the extruded material during the extrusion process. Therefore, the Cr content is set at 0.03 to 0.1% by mass.

Zinc (Zr) is added as appropriate, instead of or together with Cr, to suppress the recrystallization and refine crystal particles, thereby enhancing the strength of the extrusion. However, when the Zr content is less than 0.03% by mass, the above-mentioned effect cannot be sufficiently obtained. On the other hand, when the Zr content exceeds 0.1% by mass in adding Zr, a compound including a mixture of Al and Zr becomes coarsened during the homogenization treatment, failing to exhibit the effect of suppressing the recrystallization. Therefore, the Zr content is set at 0.03 to 0.1% by mass.

Fe: 0.2% or Less by Mass

Iron (Fe) existing as the inevitable impurity in the aluminum alloy generates β-AlFeSi phase, which is a needle-like crystallized grain, during a cooling process after casting. To reduce the β-AlFeSi content in the billet and to prevent burning during the extrusion process, the homogenization treatment needs to be performed to convert the β-AlFeSi phase into α phase (spherodizing), or the Fe content in the aluminum alloy needs to be decreased.

However, to convert the β-AlFeSi phase into α phase, the homogenization treatment is required to be carried out at a high temperature for a long time, which degrades the productivity of the extrusions. In contrast, when the Fe content of the aluminum alloy is restricted to 0.2% or less by mass, the amount of the generated β-AlFeSi phases is reduced. A manufacturing method to be described below can prevent the burning of the extrusions during the extrusion process without applying the homogenization treatment for a long time. Note that the Fe content normally included as the inevitable impurity in the aluminum alloy is approximately 0.3% by mass.

(Method for Manufacturing Aluminum Alloy Extruded Material)

Homogeneous Treatment Conditions

The homogenization treatment for the cast billet is performed under holding conditions of 500 to 550° C. for 4 to 15 hours. A holding temperature is set at 500° C. or higher, and a holding time is set at 4 hours or more. This is because strip-shaped crystallized Si phases are divided (spheroidized) while crystallized $Mg_2Si$ is solid-soluted. As the holding temperature is higher and the holding time is longer, these conditions would be more preferable for the homogenization treatment because they promote the division of Si phase and the solid solution of $Mg_2Si$ and reduce the burning. However, at a temperature exceeding 550° C., local dissolution might occur, while for a holding time exceeding 15 hours, the productivity of extrusions might be reduced. Therefore, the homogenization treatment should be performed under holding conditions, specifically, at a temperature of 500 to 550° C. and for a time of 4 to 15 hours. Note that these holding conditions cannot sufficiently achieve the conversion of β-AlFeSi phase into α phase.

Cooling Conditions after Homogenization Treatment

After the homogenization treatment, the billet is forcibly cooled at an average cooling rate of 50° C./hr or higher. Conventionally, the billet obtained after the homogenization treatment is taken out of a furnace and cooled by being allowed to stand, or by being air-cooled. In the real operation, since a number of high-temperature billets are cooled while being accumulated, the cooling rate is generally estimated to be less than 30° C./hr even in air-cooling with fans. No attention has been paid particularly to the cooling rate after the homogenization treatment. At an average cooling rate of 50° C./hr or higher, the billet is forcibly cooled to a temperature of less than 250° C., which can minimize the precipitation of $Mg_2Si$ (to such a degree that can prevent the occurrence of burning during extrusion). At a temperature of 250° C. or lower, the billet may be allowed to stand to cool to the room temperature. The desirable average cooling rate is 80° C./hr or more, which can be achieved by forcibly performing air-cooling with fans under the condition that the billets are not accumulated. Further, water cooling is more desirable. In this case, the cooling rate of about 100,000° C./hr can be achieved.

Extrusion Conditions

After the homogenization treatment, the billet is reheated to a temperature of 450 to 500° C. and then subjected to hot-extruding at an extrusion rate of 3 to 10 m/min. Since the extruded material in the present invention is a solid-core material (solid material), the extrusion ratio thereof is relatively small, and the heat generation therefrom does not become so much during processing. At an extrusion temperature of less than 450° C., the temperature of the extruded material at the outlet of an extrusion machine does not reach 500° C. or higher that is required for solution. On the other hand, once the extrusion temperature exceeds 500° C., the processing heat generation is added, increasing the temperature of extrusion material, leading to the risk of burning of the extruded material. Therefore, the extrusion temperature (heating temperature of the billet) is set at 450 to 500° C. At an extrusion rate of less than 3 m/min, the productivity of extruded materials is degraded. On the other hand, once the extrusion rate exceeds 10 m/min, the processing heat generation becomes large, increasing the temperature of material for extrusion, leading to the risk of burning of the extruded material. When the extruded material has a corner at its cross section, the phenomenon of corner cracks tends to occur as metal does not spread out into the corner. Thus, the extrusion rate is set at 3 to 10 m/min. In the manufacturing method of the present invention, the extrusion ratio (i.e. the ratio of the cross-sectional area of an extrusion container to that of the extrusion outlet) is preferably in a range of 15 to 40.

Cooling Conditions after Extrusion

The extruded material obtained directly after the extrusion process is forcibly cooled (die-quenched) online from the outlet temperature of the extrusion machine to a temperature of 250° C. or less at an average cooling rate of 50° C./sec or higher. At a temperature of 250° C. or lower, the extruded material may be allowed to stand to cool to the room temperature. By setting the average cooling rate to 50° C./sec or higher, the precipitation of $Mg_2Si$ is prevented. Preferable cooling means is water-cooling.

Aging Treatment Conditions

The extruded material die-quenched is subjected to an aging treatment. The aging treatment may be performed at a temperature of 160 to 200° C. for 2 to 10 hours.

(Number Density of AlFeSi Particles and $Mg_2Si$ Particles in Extruded Material)

The distribution state of the coarse β-AlFeSi particles and $Mg_2Si$ particles in the Al—Mg—Si based aluminum alloy extruded material in the present invention reflects the distribution state of the β-AlFeSi phase and $Mg_2Si$ phase in the billet after the homogenization treatment (after cooling).

This point will be described referring to scanning electron micrographs of FIGS. 2A to 4B.

FIGS. 2A, 3A, and 4A are the scanning electron micrographs showing the distribution states of β-AlFeSi phases and $Mg_2Si$ phases in the billets of Examples No. 1, 12, and 13, respectively. The β-AlFeSi phase is shown as white needle-like particles, and the $Mg_2Si$ phase is shown as black granular particles. FIGS. 2B, 3B, and 4B are the scanning electron micrographs showing the distribution states of AlFeSi particles and $Mg_2Si$ particles in the extrusion material obtained from these billets, respectively. The original β-AlFeSi phase is divided when being extruded and then formed into an aggregate of white granular particles.

As shown in Table 2 of Examples to be mentioned later, referring to FIG. 2B, each of the number of AlFeSi particles having a diameter of 5 μm or more and the number of $Mg_2Si$ particles having a diameter of 2 μm or more per certain area (50 μm square) falls within a specified range of the present invention. Using the distribution state of each kind of particles shown in FIG. 2B as a reference, as illustrated in FIG. 3B, the number of AlFeSi particles having a diameter of 5 μm or more is relatively large, exceeding the specified range of the present invention, while as illustrated in FIG. 4B, the number of $Mg_2Si$ particles having a diameter of 2 μm or more is relatively large, exceeding the specified range of the present invention. By comparison between the distribution state of β-AlFeSi phases and that of $Mg_2Si$ phases with reference to FIGS. 2A, 3A, and 4A, as illustrated in FIG. 2A, the amount of β-AlFeSi phases is small while the size of $Mg_2Si$ phases is small; as illustrated in FIG. 3A, the amount of β-AlFeSi phases is relatively large; and as illustrated in FIG. 4A, the size of $Mg_2Si$ phases is relatively large.

In this way, when the number of coarse AlFeSi particles having a diameter of 5 μm or more in the extruded material is large, it suggests that the amount of the β-AlFeSi phases in the billet before the extrusion (after the homogenization treatment) is large. When the number of coarse $Mg_2Si$ particles having a diameter of 2 μm or more in the extruded material is large, it suggests that the size of the $Mg_2Si$ particles in the billet before the extrusion (after the homogenization treatment) is large. These relationships can be satisfied except for when the extrusion ratio is excessively large (e.g., 45 or higher). Thus, the distribution states of the β-AlFeSi particles having a diameter of 5 μm or more and of the $Mg_2Si$ particles having a diameter of 2 μm or more in the extruded material are specified, thereby indirectly specifying the distribution states of the β-AlFeSi phases and $Mg_2Si$ phases in the billet before the extrusion (after the homogenization treatment).

When the numbers of AlFeSi particles having a diameter of 5 μm or more and $Mg_2Si$ particles having a diameter of 2 μm or more per certain area in the extruded material are within respective specific ranges in the present invention, the amount of generated β-AlFeSi phases in the billet is small, the precipitation of $Mg_2Si$ particles in the billet is suppressed, and the size of $Mg_2Si$ phase is small. Conversely, when the number of AlFeSi particles having a diameter of 5 μm or more per certain area in the extruded material exceeds the specific range in the present invention, the amount of generated β-AlFeSi phases in the billet is large. When the number of $Mg_2Si$ particles having a diameter of 2 μm or more per certain area in the extruded material exceeds the specific range in the present invention, the precipitation of $Mg_2Si$ phase in the billet is not sufficiently suppressed and the size of $Mg_2Si$ phase in the billet is large.

The number densities of the AlFeSi particles and $Mg_2Si$ particles in the present invention will be measured in the following procedure.

1) After grinding the cross section of the extruded material to have its number density measured, two or more observation regions in 50 μm square (a pair of sides being in parallel to the extrusion direction) where the number density is measured are selected from the cross section by observation with a scanning electron microscope (SEM).

2) The numbers of AlFeSi particles having a diameter of 5 μm or more and of $Mg_2Si$ particles having a diameter of 2 μm or more that are included in these observation regions are respectively measured (the diameter of each particle being the circle equivalent diameter). Note that to achieve the accurate measurements, the magnification scale of SEM is preferably set at 1,000 times or more in measuring the number of particles included in the region. The particles existing on the side of the observation region is counted as one.

3) The number of each kind of particles is measured for each selected observation region in the above-mentioned procedure 2), and an average value of the numbers of each kind of particles in all selected observation regions is determined.

(Surface Roughness of Extruded Material)

The billet of the Al—Mg—Si based aluminum alloy with the above-mentioned composition is subjected to the homogenization treatment under the conditioned mentioned above, so that the strip-shaped Si phases crystallized in the billet are spheroidized and $Mg_2Si$ is solid-soluted. Subsequently, the billet held at the homogeneous processing temperature is forcibly cooled to 250° C. or lower at a cooling rate of 50° C./hr or more, which is larger than the usual one, thereby suppressing the precipitation of $Mg_2Si$ particles during the cooling process. Since the billet is designed to reduce the amount of generated β-AlFeSi phases and to suppress the precipitation of $Mg_2Si$ phases, the peritectic reaction between the β-AlFeSi phase and $Mg_2Si$ phase is suppressed, and the precipitation of $Mg_2Si$ phase is suppressed during the extrusion process, whereby the eutectic reaction among Si, Al, and $Mg_2Si$ is also suppressed. As a result, an Al—Mg—Si based aluminum alloy extruded material (extruded material as it is) can be manufactured that reduces burning of the extruded material and has a small surface roughness. In the present invention, the surface roughness of the Al—Mg—Si based aluminum alloy extruded material can be reduced to 80 μm or lower in terms of ten-point average roughness Rz (JIS B0601:1994).

EXAMPLES

An Al—Si—Mg based aluminum alloy having a chemical composition shown in Table 1 (composition after fusion) was fused and then subjected to semicontinuous casting, thereby producing a billet having a diameter of 400 mm. The billet was subjected to the homogenization treatment under the homogenization treatment conditions (holding temperature, holding time and cooling rate) shown in Table 1. Note that the balance of the composition mentioned in Table 1 included Al and inevitable impurities except for Fe. Subsequently, extrusion molding was performed on the billet at an extrusion ratio of 33 under the extrusion conditions shown in Table 1 (extrusion temperature (billet heating temperature), extrusion rate and cooling rate), thereby producing a solid extruded material having a rectangular cross section (100 mm×40 mm), followed by an aging treatment at 180°

C. for 4 hours. Note that the term "cooling rate" in each case means a cooling rate to 250° C.

TABLE 1

| | Composition (% by mass) | | | | | | | | Homogeneous treatment conditions | | | Extrusion condition | | |
|---|---|---|---|---|---|---|---|---|---|---|---|---|---|---|
| | | | | | | | | | Temperature | Time | Cooling rate | Temperature | Rate | Cooling rate |
| No. | Si | Fe | Mg | Cu | Mn | Ti | Cr | Zr | ° C. | h | ° C./h | ° C. | m/min | ° C./s |
| 1 | 4.02 | 0.15 | 0.74 | Tr. | 0.64 | 0.02 | Tr. | Tr. | 520 | 14 | 80 | 475 | 4.5 | 100 |
| 2 | 5.81 | 0.16 | 0.34 | Tr. | 0.32 | 0.02 | Tr. | Tr. | 500 | 14 | 80 | 479 | 5.0 | 50 |
| 3 | 2.15 | 0.14 | 0.46 | Tr. | 0.95 | 0.02 | Tr. | Tr. | 520 | 14 | 80 | 480 | 5.5 | 80 |
| 4 | 5.64 | 0.20 | 0.57 | Tr. | 0.59 | 0.03 | Tr. | Tr. | 500 | 5 | 50 | 476 | 7.5 | 100 |
| 5 | 5.86 | 0.15 | 0.75 | 0.23 | 0.41 | 0.03 | Tr. | Tr. | 520 | 5 | 50 | 471 | 8.5 | 120 |
| 6 | 3.72 | 0.13 | 0.74 | 0.36 | Tr. | 0.19 | Tr. | Tr. | 520 | 5 | 50 | 470 | 8.5 | 200 |
| 7 | 4.53 | 0.05 | 0.45 | 0.38 | 0.15 | 0.04 | 0.03 | Tr. | 520 | 5 | 50 | 473 | 5.0 | 150 |
| 8 | 3.65 | 0.08 | 0.35 | Tr. | Tr. | 0.04 | Tr. | 0.08 | 520 | 14 | 80 | 490 | 3.0 | 130 |
| 9 | 3.54 | 0.14 | 0.84 | Tr. | Tr. | 0.06 | 0.03 | Tr. | 500 | 14 | 50 | 480 | 5.0 | 100 |
| 10 | 6.34* | 0.16 | 0.86 | 0.25 | Tr. | 0.02 | 0.03 | Tr. | 520 | 14 | 120 | 470 | 3.0 | 100 |
| 11 | 1.54* | 0.13 | 0.64 | Tr. | 0.36 | 0.02 | 0.03 | Tr. | 520 | 14 | 120 | 470 | 3.0 | 100 |
| 12 | 5.75 | 0.22* | 0.85 | 0.23 | Tr. | 0.02 | 0.03 | Tr. | 520 | 14 | 120 | 470 | 3.0 | 100 |
| 13 | 4.62 | 0.16 | 0.74 | Tr. | 0.63 | 0.02 | Tr. | Tr. | 520 | 14 | 40* | 470 | 3.0 | 100 |
| 14 | 4.10 | 0.14 | 0.69 | Tr. | 0.62 | 0.02 | Tr. | Tr. | 520 | 3* | 80 | 470 | 3.0 | 100 |
| 15 | 3.60 | 0.17 | 0.54 | Tr. | 0.61 | 0.02 | Tr. | Tr. | 480* | 14 | 120 | 470 | 3.0 | 100 |
| 16 | 3.72 | 0.26* | 0.62 | 0.21 | Tr. | 0.02 | 0.03 | Tr. | 520 | 14 | 120 | 470 | 2.5* | 100 |
| 17 | 4.46 | 0.23* | 0.70 | 0.23 | Tr. | 0.02 | 0.04 | Tr. | 520 | 22* | 120 | 470 | 3.5 | 100 |
| 18 | 5.64 | 0.14 | 0.90 | Tr. | 0.58 | 0.02 | Tr. | Tr. | 520 | 14 | 80 | 520* | 3.5 | 100 |
| 19 | 2.98 | 0.05 | 1.02 | Tr. | 0.57 | 0.02 | Tr. | Tr. | 520 | 14 | 80 | 470 | 12.0* | 100 |
| 20 | 3.56 | 0.16 | 0.65 | 0.56* | Tr. | 0.06 | Tr. | Tr. | 500 | 15 | 50 | 480 | 5.0 | 90 |
| 21 | 3.67 | 0.15 | 0.20* | 0.32 | Tr. | 0.06 | Tr. | 0.05 | 520 | 10 | 60 | 475 | 3.0 | 120 |
| 22 | 4.32 | 0.10 | 1.25* | Tr. | 0.45 | 0.05 | Tr. | Tr. | 515 | 6 | 100 | 480 | 3.0 | 130 |

*Item departing from specific range of the present invention

The thus-obtained extruded material was used as a sample material, and each sample material was measured on the number densities of coarse AlFeSi particles and $Mg_2Si$ particles, machinability, hardness, surface roughness (ten-point average roughness Rz), and extrudability in the following way.

(Number Densities of AlFeSi Particles and $Mg_2Si$ Particles)

After grinding the cross section of each sample material to have its number density measured, two square observation regions in 50 μm square (a pair of sides being in parallel to the extrusion direction) for measurement of the number density were selected from each sample material by observation with a scanning electron microscope (SEM). For each sample materials, the two selected observation regions were observed with the SEM having a magnification scale set at 1,000 times, and then the number of AlFeSi particles having a diameter (circle equivalent diameter) of 5 μm or more and the number of $Mg_2Si$ particles having a diameter (circle equivalent diameter) of 2 μm or more that could be observed in each observation range were measured. The average of the number of each kind of particles measured in the two observation regions was determined. The results of the measurements are shown in Table 2. Note that the particles existing on the side of the observation region was counted as one.

(Machinability)

A hole punching was performed on each sample using a commercially available high-speed steel drill having a diameter of 4 mm under the conditions, specifically, at the number of revolutions of 1500 rpm and a feeding velocity of 300 mm/min, and then the number of machining chips in 100 g machining chip aggregate obtained was counted to measure the machinability of the extruded material in each sample (fragmentation of machining chip). Samples containing more than 7000 machining chips are rated excellent "A"; samples containing 5000 to 7000 machining chips are rated good "B"; samples containing 3000 to less than 5000 machining chips are rated satisfactory "C"; and samples containing less than 3000 machining chips are rated unsatisfactory "D". The results of the measurements are shown in the item "properties" of Table 2.

(Hardness)

A Rockwall hardness (HRB) of each sample was measured based on the Rockwell hardness test of JIS Z 2245: 2011 as a test method.

(Surface Roughness)

The upper, lower, left and right surfaces (four surfaces in total) of the extruded material in each sample were visually observed across its entire length. The surface roughness (ten-point average roughness Rz) of a part of each surface, at which its surface roughness was determined to be largest by the visually observation, was measured in the direction vertical to the extrusion direction based on the standard of JIS B0601:1994. The maximum ten-point average roughness Rz obtained at each surface is shown as the surface roughness (ten-point average roughness Rz) of the extruded material in the item "properties" of Table 2.

(Extrudability)

The corners of the extruded materials in samples Nos. 1 to 22 were visually observed across the entire length of the extruded material, and the presence or absence of occurrence of any corner crack (whether the extrudability were good or bad) was checked for each sample. Additionally, regarding the billets corresponding to the extruded materials in specimen Nos. that were observed to have any corner crack, each billet was extruded at an extrusion rate lower than the extrusion rate shown in Table 1, and then the presence or absence of occurrence of the corner crack was checked. Further, regarding the billets corresponding to the extruded materials in specimen Nos. observed to have no corner crack, the billet was extruded at an extrusion rate higher than the extrusion rate shown in Table 1, and then the presence or absence of occurrence of the corner crack was checked. At this time, the extrusion rates were set at any one of 3 m/min, 5 m/min, and 10 m/min, and the homogenization treatment conditions and the extrusion conditions (except for the extrusion rate) were set as mentioned in Table 1. Samples that were observed to have no corner crack at the extrusion rate of 10 m/min were rated as having excellent extrudability "A"; samples that were observed to have a corner crack at the extrusion rate of 10 m/min but no corner crack at the extrusion rate of 5 m/min were rated as having good extrudability "B"; and samples that were observed to have a corner crack even at the extrusion rate of 3 m/min were rated as having bad extrudability "C". The results of the measurements are shown in Table 2.

TABLE 2

| | Number density of particles | | Properties | | | |
|---|---|---|---|---|---|---|
| No. | AlFeSi | $Mg_2Si$ | Machin-ability | Hardness HRB | RZ μm | Extrud-ability |
| 1 | 12 | 12 | B | 50.6 | 56 | A |
| 2 | 15 | 6 | A | 46.8 | 64 | B |
| 3 | 14 | 8 | C | 50.6 | 19 | A |
| 4 | 18 | 12 | A | 53.0 | 78 | B |
| 5 | 15 | 16 | A | 56.2 | 70 | B |
| 6 | 10 | 19 | B | 54.7 | 53 | A |
| 7 | 5 | 14 | B | 56.4 | 50 | A |
| 8 | 4 | 12 | B | 45.6 | 50 | A |
| 9 | 11 | 16 | B | 38.5 | 55.8 | A |
| 10 | 19 | 17 | A | 60.5 | 97* | B |
| 11 | 9 | 15 | D | 50.5 | 53.1 | A |
| 12 | 27* | 16 | B | 56.4 | 85.4* | B |
| 13 | 18 | 27* | B | 54.1 | 90.6* | A |
| 14 | 22* | 21* | B | 53.0 | 102* | A |
| 15 | 23* | 20 | B | 54.2 | 105* | A |
| 16 | 21* | 16 | B | 56.1 | 74.1 | A |
| 17 | 22* | 20 | B | 52.8 | 72.8 | A |
| 18 | 19 | 15 | B | 57.0 | 132* | B |
| 19 | 4 | 15 | B | 59.4 | 142* | A |
| 20 | 12 | 11 | B | 59.4 | 45.6 | C |
| 21 | 13 | 4 | B | 35.2* | 56.7 | A |
| 22 | 9 | 26* | B | 65.0 | 87.9* | A |

*Item departing from specific range of the present invention

As shown in Tables 1 and 2, the extruded materials Nos. 1 to 9 had the composition specified by the present invention and satisfied the number densities of the AlFeSi particles and $Mg_2Si$ particles, whereby these extruded materials had a small surface roughness (ten-point average surface roughness Rz≤80 μm) and excellent machinability. Further, these extruded materials had a Rockwell hardness of 38 HRB or more and excellent strength. The extruded materials Nos. 1 to 9 were manufactured by the manufacturing method specified by the present invention. FIGS. 2A and 2B illustrate the scanning electron micrographs of the billet No. 1 (after the homogenous treatment) and the extruded material obtained from the billet No. 1, respectively.

On the other hand, the extruded material No. 10 had burning occurred because of the excessive Si content and had the large surface roughness.

The extruded material No. 11 had degraded machinability because of excessively small Si content.

In the extruded material No. 12, the number density of AlFeSi particles exceeded the specific range of the present invention because of the excessive content of Fe as inevitable impurity, resulting in large surface toughness (ten-point average toughness Rz>80 μm). FIGS. 3A and 3B illustrate the scanning electron micrographs of the billet No. 12 (after the homogenous treatment) and the extruded material obtained from the billet No. 12, respectively. As shown in FIG. 3A, the amount of β-AlFeSi phases is large in the billet, causing burning during the extrusion process, resulting in the large surface roughness.

In the extruded material of sample No. 13, the number density of $Mg_2Si$ particles exceeded the specific range of the present invention, resulting in large surface roughness (ten-point average roughness Rz>80 μm). FIGS. 4A and 4B illustrate the scanning electron micrographs of the billet No. 13 (after the homogenous treatment) and the extruded material obtained from the billet No. 13, respectively. As shown in FIG. 4A, since the cooling rate after the homogenization treatment is low, the size of the $Mg_2Si$ phase in the billet becomes large, causing burning during the extrusion process, resulting in a large surface roughness.

In the extruded material of sample No. 14, the number densities of AlFeSi particles and $Mg_2Si$ particles exceeded the respective specific range of the present invention, and in the extruded material of sample No. 15, the number density of AlFeSi particles exceeded the specific range of the present invention, resulting in large surface roughness in both sample No. 14 and No. 15 (ten-point average roughness Rz>80 μm). This is because in sample No. 14, the time for the homogenization treatment was short, while in sample No. 15, the temperature of the homogenization treatment was low, whereby in both samples, the conversion of the β-AlFeSi particles into α phase did not proceed, and the division of the Si phase as well as the solid-solution of $Mg_2Si$ phase in the billet were insufficient.

In both the extruded materials in samples No. 16 and 17, the Fe content was excessive, and the number density of AlFeSi particles exceeded the specific range of the present invention, but the surface roughness was small (ten-point average roughness Rz≤80 μm). This is because in sample No. 16, the extrusion rate was set much lower than the lower limit of the specific range, namely, 3 m/min, while in sample No. 17, the time for the homogenization treatment was set much longer than the upper limit of the specific range, namely, 15 hours. In this way, the productivity in each of samples No. 16 and 17 was degraded.

In the extruded materials of samples No. 18 and 19, both the number densities of AlFeSi particles and $Mg_2Si$ particles satisfied the specific ranges of the present invention, but their surface roughness were large (ten-point average roughness Rz>80 μm). This is because in sample No. 18, the extrusion temperature was too high, while in sample No. 19, the extrusion rate was too high, increasing the material temperature due to the heat generation during the processing, causing burning in the extruded material.

In the extruded material of sample No. 20, the Cu content was excessive, and thus the extrudability were degraded.

In the extruded material of sample No. 21, the Mg content was too small, and thus the strength (hardness) thereof was low.

In the extruded material of sample No. 22, the Mg content was excessive, and the number density of $Mg_2Si$ particles exceeded the specific range of the present invention, resulting in a large surface roughness (ten-point average roughness Rz>80 μm). This is considered to be because $Mg_2Si$ phases are formed in a large amount in the billet due to the excessive Mg content, causing burning in the extruded material during the extrusion process.

The present application claims priority based on Japanese Patent Application No. 2013-177572 filed on Aug. 29, 2013 and Japanese Patent Application No. 2014-156634 filed on Jul. 31, 2014, the disclosures of all of which are incorporated into the present specification by reference.

The invention claimed is:

1. A method for manufacturing an Al—Si—Mg based aluminum alloy extruded material with excellent machinability using an aluminum alloy billet comprising:

Si: 2.0 to 6.0% by mass;

Mg: 0.3 to 1.2% by mass; and

Ti: 0.01 to 0.2% by mass, a Fe content being restricted to 0.2% or less by mass, with the balance being Al and inevitable impurities, the method comprising:

applying a homogenization treatment to the aluminum alloy billet by keeping the aluminum alloy billet at 500 to 550° C. for 4 to 15 hours; then forcibly cooling the aluminum alloy billet to 250° C. or lower at an average cooling rate of 50° C./hr or higher; then hot-extruding the aluminum alloy billet at an extrusion ratio of 15 to 40 and an extrusion rate of 3 to 10 m/min by heating at 450 to 500° C. to form the extruded material;

forcibly cooling the extruded material at an average cooling rate of 50° C./sec or higher; and applying an aging treatment to the extruded material;

wherein the number of AlFeSi particles having a diameter of 5 μm or more is 20 or less per 50 μm square area of the extruded material, the number of $Mg_2Si$ particles having a diameter of 2 μm or more is 20 or less per 50 μm square area of the extruded material, and a ten-point average roughness Rz of a surface of the extruded material is 80 μm or less.

2. The method for manufacturing an Al—Si—Mg based aluminum alloy extruded material according to claim 1, the aluminum alloy billet further comprising one or more kinds of:

Mn: 0.1 to 1.0% by mass; and

Cu: 0.1 to 0.4% by mass.

3. The method for manufacturing an Al—Si—Mg based aluminum alloy extruded material according to claim 1, the aluminum alloy billet further comprising one or more kinds of:

Cr: 0.03 to 0.1% by mass; and

Zr: 0.03 to 0.1% by mass.

4. The method for manufacturing an Al—Si—Mg based aluminum alloy extruded material according to claim 2, the aluminum alloy billet further comprising one or more kinds of:

Cr: 0.03 to 0.1% by mass; and

Zr: 0.03 to 0.1% by mass.

5. The method for manufacturing an Al—Si—Mg based aluminum alloy extruded material according to claim 1, wherein the aging treatment is applied to the extruded material at a temperature of 160-200° C. for 2-10 hours.

6. The method for manufacturing an Al—Si—Mg based aluminum alloy extruded material according to claim 1, wherein the aging treatment is applied to the extruded material at a temperature of 160-180° C. for 4-10 hours.

7. The method for manufacturing an Al—Si—Mg based aluminum alloy extruded material according to claim 1, wherein the extruded material is forcibly cooled during or after the hot-extruding by die-quenching.

8. The method for manufacturing an Al—Si—Mg based aluminum alloy extruded material according to claim 1, wherein:

Mg: 0.45-1.2% by mass.

9. The method for manufacturing an Al—Si—Mg based aluminum alloy extruded material according to claim 1, wherein the aluminum alloy billet comprises:

Mg: 0.5-0.9% by mass.

10. The method for manufacturing an Al—Si—Mg based aluminum alloy extruded material according to claim 1, wherein the number of AlFeSi particles having a diameter of 5 μm or more is 10 or less per 50 μm square area of the extruded material.

11. The method for manufacturing an Al—Si—Mg based aluminum alloy extruded material according to claim 1, wherein the number of $Mg_2Si$ particles having a diameter of 2 μm or more is 16 or less per 50 μm square area of the extruded material.

12. The method for manufacturing an Al—Si—Mg based aluminum alloy extruded material according to claim 1, wherein the 10-point average roughness Rz of a surface of the extruded material is 70 μm or less.

13. The method for manufacturing an Al—Si—Mg based aluminum alloy extruded material according to claim 1, wherein the aluminum alloy billet comprises:

Si: 2.15 to 5.86% by mass;

Fe: 0.05 to 0.20% by mass;

Mg: 0.34 to 0.84% by mass; and

Ti: 0.02 to 0.19% by mass.

* * * * *